United States Patent [19]

Tobias et al.

[11] Patent Number: 4,732,301

[45] Date of Patent: Mar. 22, 1988

[54] ICE DISPENSER

[75] Inventors: Lamar K. Tobias, Richland; Hugh J. Chapman, Kalamazoo; Daniel R. Herzog, Delton; Harold W. Williams, Paw Paw, all of Mich.

[73] Assignee: Tobias Enterprises, Inc., Kalamazoo, Mich.

[21] Appl. No.: 7,228

[22] Filed: Jan. 27, 1987

[51] Int. Cl.[4] ..... F25C 5/18

[52] U.S. Cl. ..... 222/203; 62/344; 222/238; 414/304

[58] Field of Search ..... 62/344; 222/202, 203, 222/238; 414/304, 310, 311, 326

[56] References Cited

U.S. PATENT DOCUMENTS

| | | | |
|---|---|---|---|
| 1,570,795 | 1/1926 | Tainton | 222/202 X |
| 2,381,802 | 8/1945 | Booth et al. | 222/203 X |
| 2,732,099 | 1/1956 | Davis | 222/203 X |
| 3,045,717 | 7/1962 | Vogl | 222/203 X |
| 3,346,917 | 10/1976 | Lennox | 222/203 X |
| 3,556,352 | 1/1971 | Roberts | 222/203 |
| 3,913,343 | 10/1975 | Rowland et al. | 62/344 X |

*Primary Examiner*—William E. Tapolca

*Attorney, Agent, or Firm*—Flynn, Thiel, Boutell & Tanis

[57] ABSTRACT

An arrangement for preventing the development of a frozen bond between individual pieces of cubed or crushed ice collected in a storage bin. The arrangement includes an upstanding flexible wall lining a majority of the inwardly facing wall surface of a storage bin. An agitator device is provided for moving the pieces of ice about within the confines defined by the flexible wall. The agitator includes a rotatable shaft, an arm secured to the rotatable shaft and extending radially thereof and a drive arrangement for drivingly rotating the shaft. Structure is provided for effecting a flexing of the flexible wall toward and away from the inwardly facing walls of the storage bin. The agitator device and the additional structure causing a flexing of the flexible wall periodically initiates a movement of the individual pieces of ice to thereby prevent the development of a frozen bond between the individual pieces of ice.

13 Claims, 6 Drawing Figures

ICE DISPENSER

FIELD OF THE INVENTION

This invention relates to dispensers for ice and other particulate and fluid materials, and more particularly to an arrangement for preventing the development of a frozen bond between individual pieces of cubed or crushed ice collected in a storage bin.

BACKGROUND OF THE INVENTION

Ice is commonly made available in hotels, motels, marinas, trailer parks, camps and other public or semi-public places by way of a machine which serves as both the ice maker and a bulk storage facility. Care and upkeep of these machines is essential because after the ice remains stagnant for a period of time, a frozen bond will develop between the pieces of ice thereby making removal of the ice from the storage bin difficult, if not impossible. Proprietors of the hotels, motels, etc., have had to, in the past, empty the storage bin by virtually chiseling the bonded cubed or crushed ice from the storage bin to enable the ice maker to fill the storage bin with "fresh" ice. This is a very time consuming task and must be repeated time and time again.

If ice were frequently removed from the storage bin, enough movement of the ice is generally generated so as to prevent the development of a frozen bond between the individual pieces of ice. However, the time period during which there is a demand for ice is generally limited to a three or four hour period of time, generally between the hours of 5:00 p.m. and 9:00 p.m. as people begin to prepare for an evening of relaxation. Between the hours of 9:00 p.m. and 5:00 p.m. the next day, there is very little demand for ice and, as a result, the ice remains stagnant for a prolonged period of time and a frozen bond develops between the individual pieces of ice. The amount of ice that becomes frozen together continues to grow until the storage bin is nearly unusable because a majority of the pieces of ice are frozen together.

Accordingly, it is an object of this invention to provide an arrangement for preventing the development of a frozen bond between individual pieces of cubed or crushed ice collected in a storage bin.

It is a further object of this invention to provide an arrangement which periodically moves the ice collected in the storage bin, whether ice is being removed from the storage bin or not, to prevent the development of a frozen bond between the individual pieces of ice.

It is a further object of this invention to provide a storage bin for collecting ice which remains virtually maintenance free thereby making it unnecessary for the proprietor of an establishment having an ice making machine to periodically check same to make certain that the pieces of ice collected therein have not become frozen together.

It is a further object of this invention to provide an arrangement for preventing the development of a frozen bond between individual pieces of ice, as aforesaid, which is durable in its construction and requires little or no maintenance.

It is a further object of this invention to provide, in combination with an arrangement for preventing the development of a frozen bond between individual pieces of ice, a dispenser enabling a dispensing of ice from the storage bin without enabling the end user of the ice to have free access to the storage bin.

SUMMARY OF THE INVENTION

The objects and purposes of the invention are met by providing an arrangement for preventing the development of a frozen bond between individual pieces of cubed or crushed ice collected in a storage bin, which arrangement includes upstanding flexible walls lining a majority of the inwardly facing wall surfaces of the storage bin. The upstanding flexible walls are adapted to flex toward and away from the inwardly facing walls of the storage bin. An agitator device is provided for moving the cubed or crushed ice about within the confines defined by the flexible walls. The agitator device includes a rotatable shaft, an arm secured to the rotatable shaft and extending radially thereof and a drive mechanism for drivingly rotating the shaft. Structure is additionally provided for effecting a flexing of the flexible walls toward and away from the inwardly facing walls of the storage bin. The agitator device and the additional structure for effecting a flexing of the flexible walls causes a movement of the pieces of ice to thereby prevent the development of a frozen bond between the individual pieces of ice.

BRIEF DESCRIPTION OF THE DRAWINGS

Other objects and purposes of this invention will be apparent to persons acquainted with apparatus of this general type upon reading the following specification and inspecting the accompanying drawings, in which.

DETAILED DESCRIPTION

Figure 1:
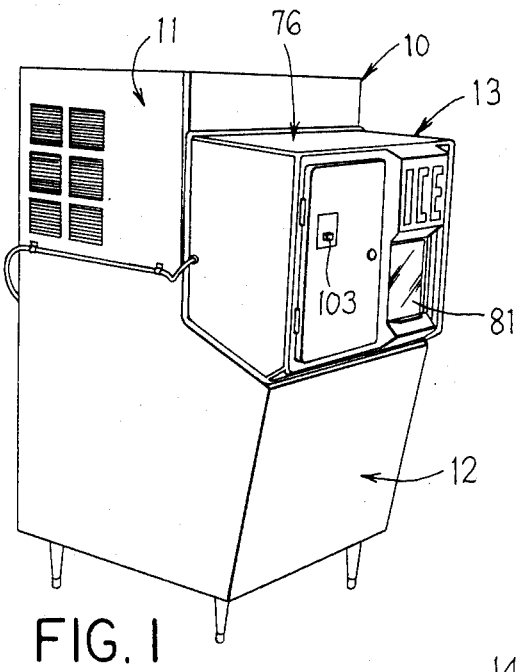
FIG. 1 is a perspective view of an ice making machine capable of making a quantity of ice and storing it in a storage bin positioned immediately therebelow.

Certain terminology will be used in the following description for convenience in reference only and is not to be considered limiting. For example, the words "up38 , "down38 , "front" and "rear" will designate directions in the drawings to which reference is made. The words "in" and "out" will respectively refer to directions toward and away from the geometric center of the ice maker and designated parts thereof. Such terminology will include the words specifically mentioned above, derivatives thereof and words of similar import.

One problem which is posed by the conventional ice making machine is one of sanitation. That is, there is little or no control over the introduction of contaminants into the ice by diseased persons, animals, vandals and other sources. Thus, the ice making machine 10 illustrated in FIG. 1 is completely enclosed so as to prevent direct access to the ice stored within a storage bin. Referring to the ice maker 10 in FIG. 1, the ice making section 11 is oriented above the storage bin section 12. The ice making section 11 and the storage bin section 12 are of a conventional construction. Applicants improvement is the provision of an arrangement 13 which is readily adaptable for use in conventional ice making machines 10 with little or no modification being required to the existing structure.

Figure 2:
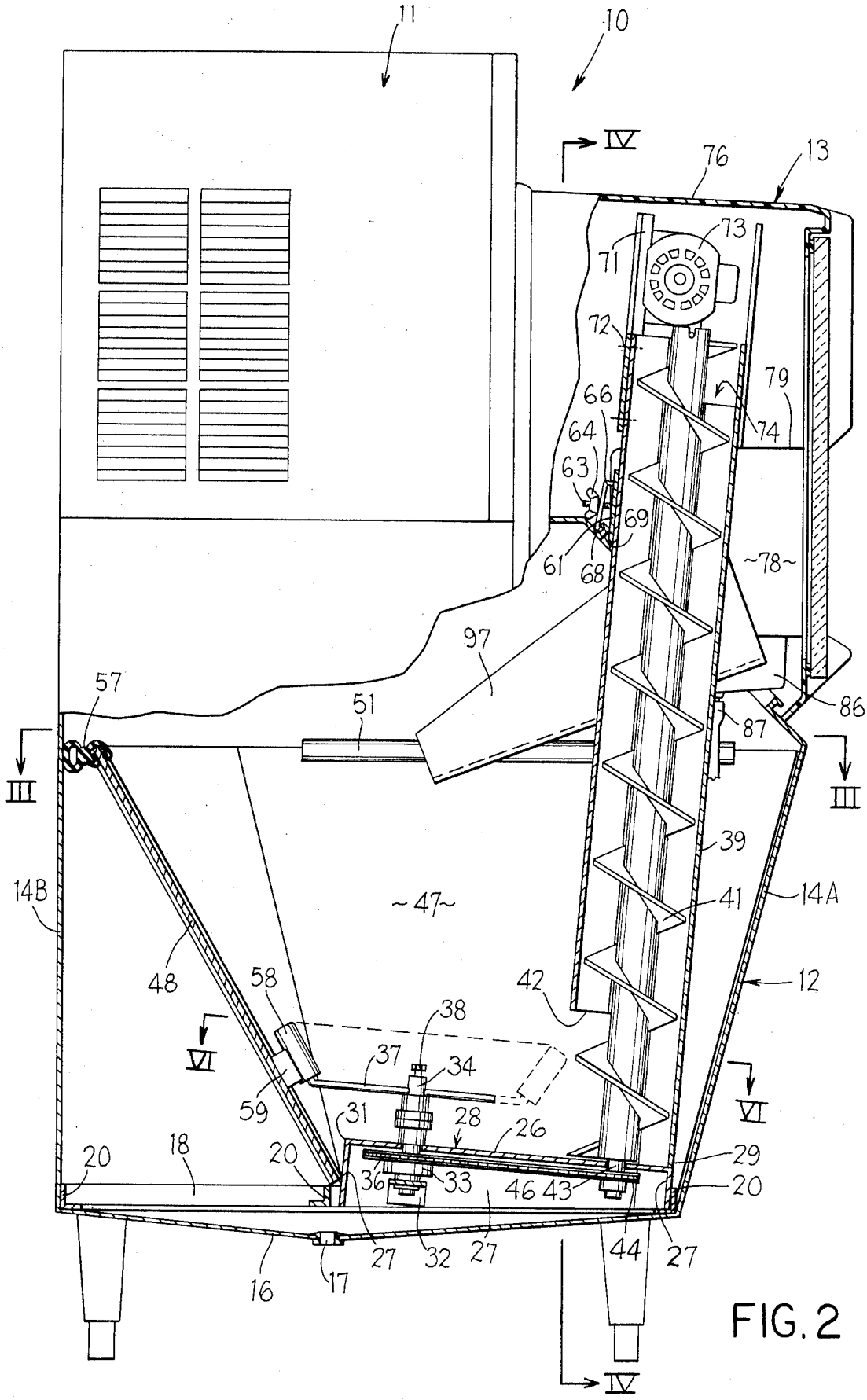
FIG. 2 is a central cross-sectional view of the ice bin and dispenser illustrated in FIG. 1.

More specifically, and referring to FIG. 2, the storage bin section 12 of the ice making machine 10 includes a plurality of upstanding walls 14A, 14B and 14C and a bottom wall 16. The bottom wall 16 is provided with an outlet opening 17 to facilitate the drainage of melted ice from within the storage bin section 12. The bottom wall 16 is also somewhat of an inverted cone shape with the opening 17 being provided at the vertex of the cone angle.

Figure 4:
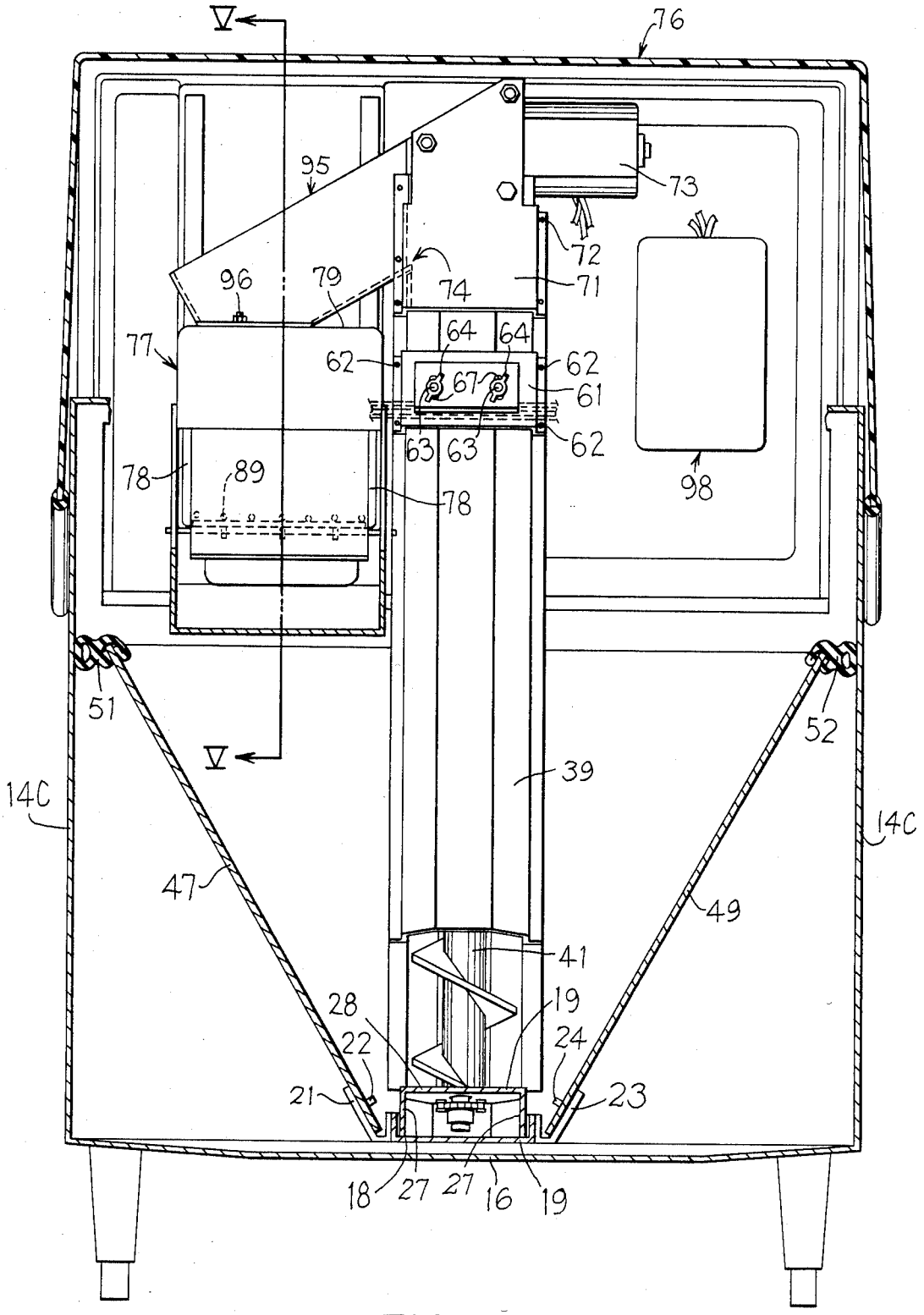
FIG. 4 is a sectional view taken along the line IV—IV of FIG. 2.

A pair of angle support bars 18 and 19 rest on the bottom wall 16 adjacent the front upstanding wall 14A and the rear upstanding wall 14B. The angle support bars are straight and bridge the depression defined by the conically shaped bottom wall 16 as illustrated in FIG. 2. Cross bracing 20 is provided between the angle support bars 18 and 19 at the front and rear ends thereof as well as at a midportion as best illustrated in FIG. 2. A pair of wings 21 are fixedly secured to the angle support bar 18. An upstanding pin 22 is provided on each wing 21. A pair of wings 23 are fixedly secured to the angle support bar 19. An upstanding pin 24 is provided on each wing 23. In this particular embodiment, the wings 21 and 23 are inclined to the vertical at an angle in the range of 40° to 60° as illustrated in FIG. 4.

A chasis 26 is mounted on the angle support bars 18 and 19 and extends therebetween. The chasis 26 includes plural and upstanding side walls 27 mounted on the angle support bars 18 and 19 and an interconnecting top wall or plate 28. The top plate 28 is inclined to the horizontal, the front edge 29 thereof being lower than the rear edge 31 thereof. A bracket 32 is secured to and extends between a pair of upstanding side walls 27 of the chasis 26 and supports a bearing 33. A shaft 34 is rotatably supported in the bearing and extends upwardly through an opening in the plate 28. A sprocket wheel 36 is fixedly secured to the shaft 34. A diametric opening is provided in the shaft 34 and receives therein an elongated arm 37. The elongated arm is slidable back and forth in the opening and is adapted to be fixedly positioned relative to the shaft 34 by a screw 38.

A tubular shroud 39, octogon in cross section, is fixedly secured to the plate 28 and extends perpendicularly upwardly therefrom adjacent the front edge 29 thereof. An auger screw 41 is rotatably housed within the tubular shroud 39. The tubular shroud 39 has an opening 42 at the lower end thereof and which faces the shaft 34 and arm 37 thereon. The auger screw 41 extends into the opening 42 with an end 43 thereof extending through an opening in the top plate 28. A sprocket wheel 44 is secured to the end 43. An endless chain 46 extends between and drivingly connects the sprocket wheels 44 and 36.

Figure 3:
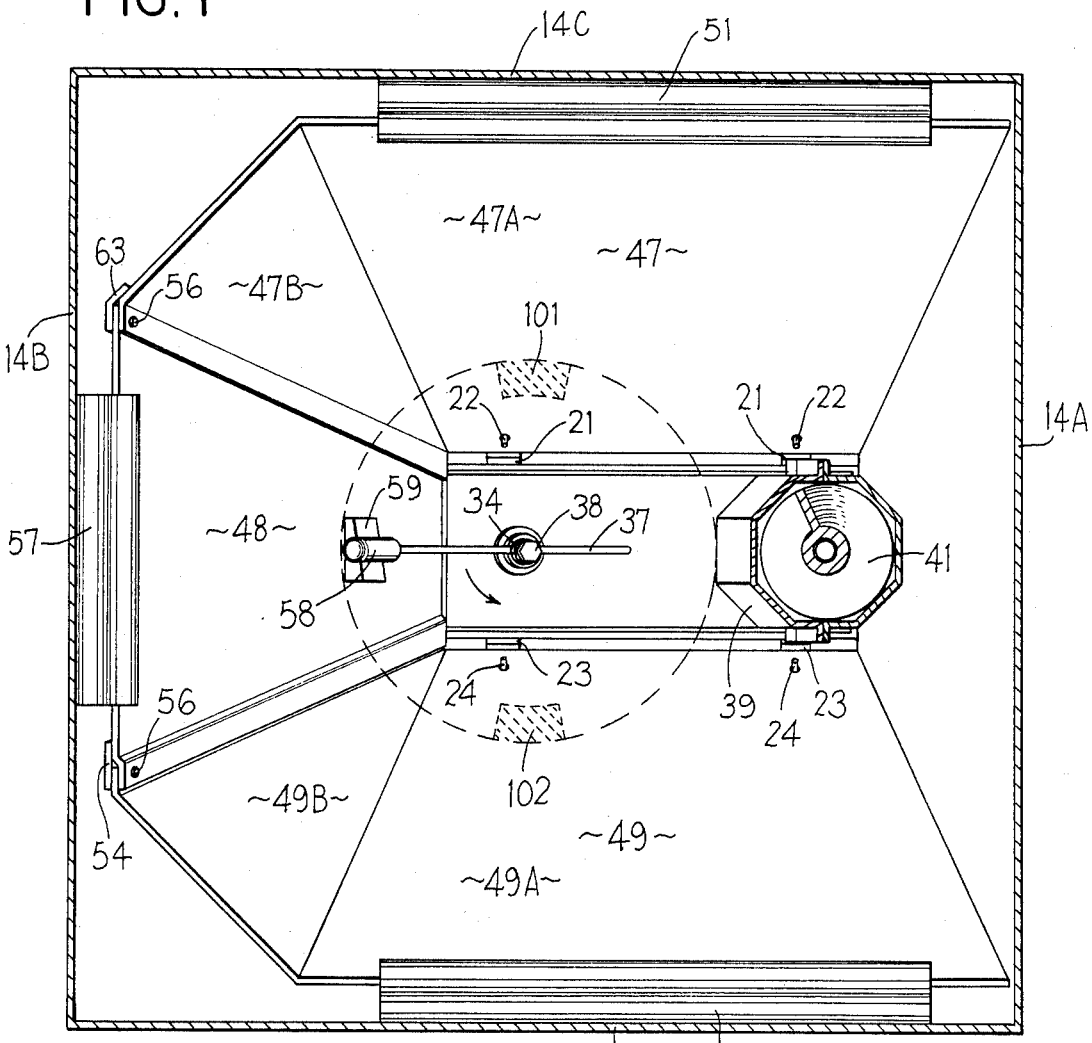
FIG. 3 is a sectional view taken along the line III—III of FIG. 2.

An arrangement of flexible walls 47, 48 and 49 are provided in the storage bin section 12 as illustrated in FIG. 3. The flexible walls 47, 48 and 49 are in this embodiment made of metal, and are elastically yieldable to a force applied to a surface area thereof. In this particular embodiment, the flexible wall 47 has a pair of holes adjacent the lower edge thereof and which receive therein the upstanding pins 22 mounted on the wings 21. The upper edge of the flexible wall 47 has an elastomeric member 51 coupled thereto and which extends between the upper edge and the inwardly facing side of the upstanding wall 14C. The flexible wall 47 comprises a wall segment 47A which extends coextensively with the upstanding wall segment 14C and a wall segment 47B which is oriented at an angle thereto as illustrated in FIG. 3. Similarly, the flexible wall 49 has a pair of openings therein adjacent the lower edge and receives therein the upstanding pins 24 on the wings 23. The upper edge of the flexible wall 49 has an elastomeric member 52 secured thereto and extending between the upper edge and the inwardly facing side of the upstanding wall 14C. The flexible wall 49A includes a wall section 49A which extends from front to rear of the storage bin section coextensively with the wall 14C and a wall segment 49B which extends at an angle thereto. The wall segment 47B has structure 53 defining a track adapted to receive therein one edge of the flexible wall 48. The other edge of the flexible wall 48 has structure 54 thereon defining a track adapted to receive therein the free edge of the wall segment 49B. A screw 56 is provided for pivotally securing the upper edge of the wall segment 47B to the upper edge of the flexible wall 48 as well as securing the upper edge of the wall segment 47B to the upper other edge of the flexible wall 48. An elastomeric member 57 is secured to the upper edge of the flexible wall 48 and extends between the upper edge of the wall 48 and the upstanding rear wall 14B.

An end of the arm 37 remote from the shaft 34 is bent angularly upwardly and has a roller 58 rotatably secured thereto. In this particular embodiment, a wedge shaped block 59 is secured to the inwardly facing side of the flexible wall 48 as illustrated in FIGS. 2 and 3. The purpose of this wedge shaped block 59 will be explained below.

A bracket 61 (FIGS. 2 and 4) is secured to the tubular shroud 39 by spot welding as indicated at 62. The bracket 61 has a pair of externally threaded studs 63 thereon adapted to receive a wing nut 64. The externally threaded studs 63 project rearwardly from the tubular shroud 39 as illustrated in FIG. 2. A plate 66 having a lip 68 thereon is provided, which plate 66 has a pair of openings 67 therein adapted to receive the externally threaded studs 63. The lip 68 operatively engages a further lip 69 provided on the ice making machine 10. The lip 68 opens generally in a rearwardly direction so that the generally frontwardly extending lip 67 received therein will, upon turning of the wing nuts 64 draw the plate 66 toward the bracket 61 to clamp the lip 68 therebetween and to generally fix the tubular shroud 39 to the ice making machine 10 adjacent its upper end.

A motor mounting bracket 71 is fixed to the upper end of the tubular shroud 39 by spot welding as indicated at 72. The motor mounting bracket 71 supports an electric motor 73 as illustrated in FIGS. 2 and 4. The electric motor 73 is drivingly coupled in a conventional manner to the shaft of the auger screw 41 so that upon a rotation of the output shaft of the motor 73, the auger screw 41 will rotate. An ice outlet opening 74 is provided in the upper end of the tubular shroud 39 as illustrated in FIG. 2.

Figure 5:
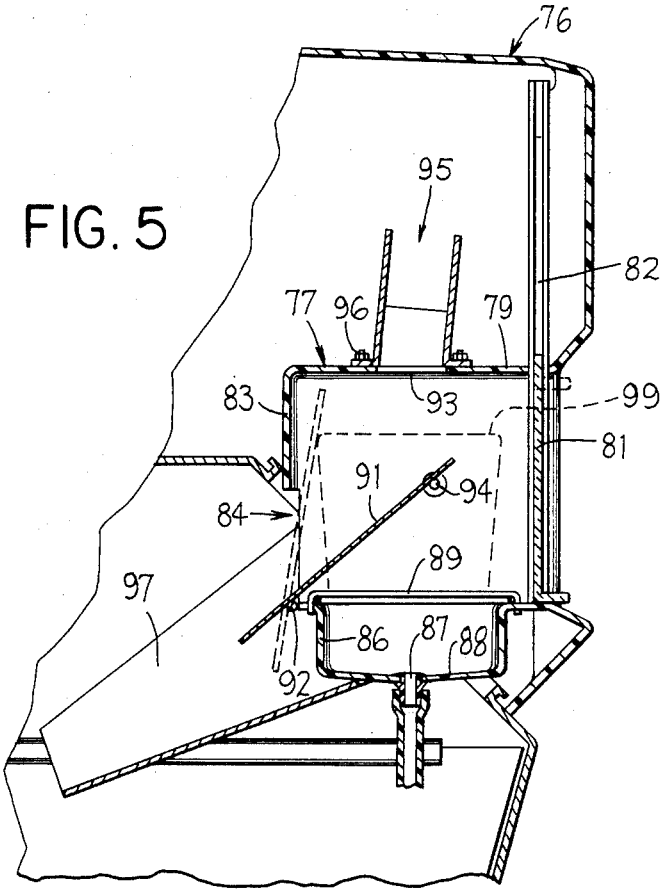
FIG. 5 is a sectional view taken along the line V—V of FIG. 4.

In this particular embodiment, the arrangement 13 includes a molded housing 76 for covering the upper end of the tubular shroud 39 and electric motor 73. The molded cover 76 also includes a molded compartment 77 having a pair of side walls 78 and a top wall 79. The front wall of the compartment 77 is defined by a sliding door 81 which, in this particular embodiment, is transparent and is liftable in a guide slot 82. The rear wall 83 of the compartment 77 has an opening 84 therein adjacent the lower portion thereof. The bottom wall of the compartment 77 is defined by a bowl shaped segment 86 having a drain outlet 87 in the bottom wall 88 thereof, which drain outlet 87 extends to a location external of the ice making machine. A grid 89 covers the bowl shaped segment 86 and defines a platform. A plate 91 is pivotally secured to the compartment 77 adjacent the juncture between the bowl shaped segment 86 and the rear wall 83, as at 92. The plate normally rests on an activating arm 94 of a not illustrated switch so that the plate 91 extends at an angle to the vertical within the compartment 77. The plate 91 slopes from the front portion of the compartment 77 downwardly and to the rear out through the opening 84 in the rear wall 83 as illustrated in FIG. 5. An opening 93 is provided in the top wall 79 of the compartment 77 and a ice carrying chute 95 is secured to the top wall 79 of the compartment 77 by a plurality of bolts 96 as illustrated in FIG. 5. The chute extends upwardly from the opening 93 and at an angle from the top wall 79 to the outlet opening 74 at the upper end of the tubular shroud 39. The opening 93 in the top wall 79 is positioned so that it is above the plate 91 when the plate rests against the switch arm 94. A further chute 97 is secured to the side walls 78 of the compartment 77 and extends further rearwardly from the compartment 77 to a location that is generally immediately above the axis of the shaft 34 as illustrated in FIG. 2.

A control circuit 98 is provided in a box provided on the inside of the molded cover 76 as illustrated in FIG. 4. The control circuit 98 is generally a timer circuit that activates the motor 73 about once every hour. The motor 73 can only be activated by the timer when the plate 91 is resting against the switch arm 94 as illustrated in solid lines in FIG. 5. When the plate 91 is pivoted to the broken line position illustrated in FIG. 5, the plate 91 is no longer in engagement with the switch arm 94 and the motor 73 will be temporarily deactivated until the plate 91 comes into engagement with the switch arm 94 again. A disengagement of the plate 91 will be caused by an end user of the ice placing a bucket 99 on top of the grid 89 so as to push the plate 91 to its broken line position illustrated in FIG. 5. A removal of the bucket 99 will cause the plate 91 to pivot under the effective gravity back to the broken line position illustrated in FIG. 5.

OPERATION

While the operation of the device described above will be readily apparent to persons of ordinary skill in the art based upon a reading of the preceding text, a brief description of the operation will be given for convenience.

Figure 6:
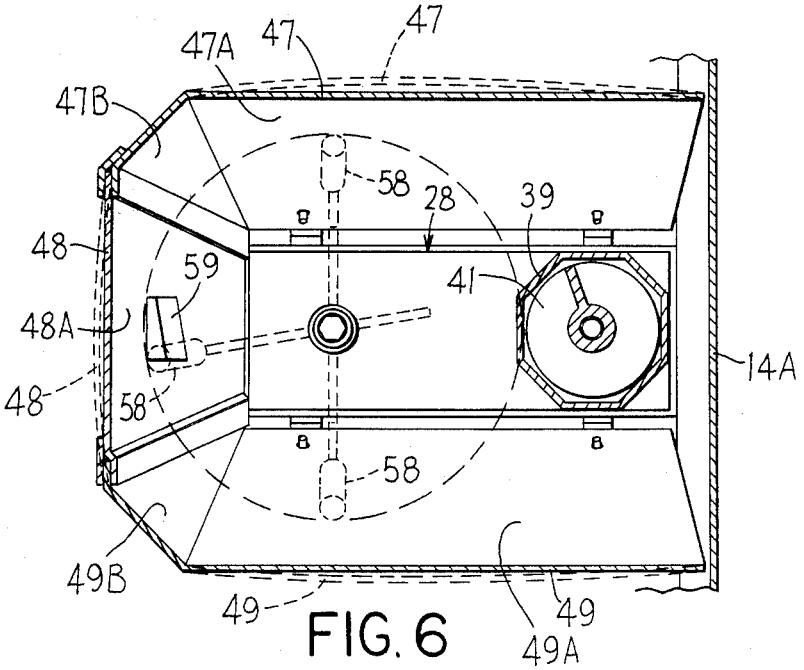
FIG. 6 is a sectional view taken along the line VI—VI of FIG. 2.

The ice maker section 11 will generate cubed ice or crushed ice, namely, pieces of ice which will fall therefrom into the storage bin 12 and, particularly, between the front wall 14A and the flexible walls 47, 48 and 49. If the pieces of ice are not periodically moved, they will become bonded together due to freezing. Thus, we have provided a timer circuit 98 which will, about every hour, activate the electric motor 73 to drive the auger screw 41 and thence the arm 37 for rotation. When the arm 37 is rotated, the roller 58 thereon will engage the flexible wall 47 in the shaded zone marked 101 (FIG. 3), the wedge shaped block 59 on the flexible wall 48 and the shaded zone marked 102 on the flexible wall 49. Since the spacing of the wall surface on the respective flexible walls 47 and 49 and the ramp surface on the wedge shaped block 59 is less than the dimension between the axis of the shaft 34 and the external part of the roller 58, a movement of the roller into engagement with the respective surfaces on the flexible walls 47, 48 and 49 will cause the flexible walls to flex to the broken line positions illustrated in FIG. 6. Simultaneously, ice will be brought by the arm 37 to the opening 42 in the lower end of the tubular shroud 39 and the rotating auger screw will carry ice up through the interior of the tubular shroud 39 so that it will dump into the outlet opening 74. Ice exiting the outlet opening 74 will slide down the chute 95 and into the compartment 77 through the opening 93 in the top wall 79 thereof. The ice will thereafter slide down the plate 91 and chute 97 and drop back into the storage bin section 12. The agitation generated by the rotating arm 37 and a movement of a portion of the ice within the storage bin up the auger screw and thence recirculated back into the top portion of the storage bin filled with ice will prevent the pieces of ice from becoming bonded together. The sea of ice within the storage bin will virtually undulate as the flexible walls 47, 48 and 49 flex outwardly and inwardly and, due to a quantity of ice being removed from the storage bin by the auger screw 41, all of the ice will move downwardly toward the opening 42. All of this motion by the pieces of ice will serve to prevent the pieces from becoming bonded together due to freezing.

An end user desiring ice from the ice making machine 10, may simply lift the door 81 and insert a bucket 99. A button 103 is provided on the front face of the molded cover 76, which button activates electric circuitry to activate the motor 73 to allow pieces of ice to be brought up from the storage bin and dumped into the compartment 77 and a bucket 99 resting on the upper surface of the grid 89.

An unscrupulous person attempting to place a contaminant into the storage bin 12 will be thwarted in the effort due to the provision of a drain outlet 87 provided in the bowl shaped segment 86 of the compartment 77. Any contaminant will drain out through the outlet 87 to an external location from the ice making machine 10.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive porperty of privilege is claimed are defined as follows:

1. An arrangement for preventing the development of a frozen bond between individual pieces of cubed or crushed ice collected in a storage bin, comprising:

upstanding flexible wall means lining a majority of the inwardly facing wall surface of said storage bin, said upstanding flexible wall means being adapted to flex toward and away from said inwardly facing walls of said storage bin;

agitator means for moving said cubed or crushed ice about within the confines defined by said flexible wall means, said agitator means including a rotatable shaft, an arm secured to said rotatable shaft and extending radialy thereof and a drive means for drivingly rotating said shaft; and means for effecting a flexing of said flexible wall means toward and away from said inwardly facing walls of said storage bin, said agitator means and said means effecting a flexing of said flexible wall means causing a movement of said cubed or crushed ice to prevent the development of any frozen bond between the individual pieces of ice, said arm having means on an end thereof remote from said rotatable shaft for engaging at least a portion of each of said wall surfaces on each pass therepast, said means effecting a pushing of said wall surface and an elastic yielding thereof outwardly away from a central region of a bottom wall of said storage bin so that said cubed or crushed ice will move under the effect of gravity to occupy the expanded space created by said elastic yielding of said wall surface, said wall surface returning to its original position following a disengagement of said arm therewith to again cause movement of said cube or crushed ice and a breaking of any frozen bond that may exist between said pieces of ice.

2. The arrangement according to claim 1, wherein said upstanding flexible wall means include plural upstanding wall surfaces and support means for supporting each of said wall surfaces at an angle inclined inwardly of said storage bin and to the vertical, from a top edge of said wall surfaces so that said cubed or crushed ice will always be urged by gravity toward said central region of said bottom wall of said storage bin; and wherein said rotatable shaft and arm thereon are oriented adjacent said bottom wall and said central region thereof.

3. The arrangement according to claim 1, wherein between an upper edge of each of said wall surfaces and said inwardly facing walls of said storage bin there is provided a resilient member to further enhance the elastic characteristic of said wall surfaces.

4. The arrangement according to claim 1, wherein said agitator means includes a dispensing means for removing said pieces of ice from said storage bin for use by an end user.

5. The arrangement according to claim 4, wherein said dispensing means includes a return means defining a return path to said storage bin so that pieces of ice removed from said storage bin can be returned to said storage bin.

6. The arrangement according to claim 5, wherein said dispensing means includes means for removing pieces of ice oriented adjacent a bottom wall of said storage bin, said return means effecting a return of said pieces of ice to the top of the quantity of ice collected in said storage bin.

7. The arrangement according to claim 6, wherein said agitator means includes a control means for periodically activating said drive means and said dispensing means for the purpose of periodically causing a movement of said pieces of ice within said storage bin to prevent the development of any frozen bond therebetween.

8. The arrangement according to claim 5, wherein said return means includes a movable gate manually movable between first and second positions, said first position of said gate causing said pieces of ice removed from the bottom of said storage bin to be returned to said storage bin, said second position of said gate causing said pieces of ice removed from said storage bin to be delivered to said end user.

9. The arrangement according to claim 8, wherein said dispenser means includes a compartment accessible by said end user through a door, said movable gate being oriented in said compartment.

10. The arrangement according to claim 9, wherein said compartment includes means defining a drain for draining liquid collected inside said compartment to an opening external of said storage bin.

11. The arrangement according to claim 4, wherein said dispensing means includes a rotatable auger disposed in a tubular housing for lifting said pieces of ice from a bottom of said storage bin, said tubular housing having an inlet opening adjacent said bottom of said storage bin, said arm bringing said pieces of ice to said opening and said auger.

12. The arrangement according to claim 11, wherein said drive means simultaneously drives said rotatable shaft and said rotatable auger.

13. The arrangement according to claim 1, wherein said agitator means includes a dispensing means for removing said pieces of ice from said storage bin for use by an end user; and wherein said agitator means includes a control means for periodically activating said drive means and said dispensing means for the purpose of periodically causing a movement of said pieces of ice within said storage bin to prevent the development of any frozen bond therebetween.

* * * * *